United States Patent [19]

Dykehouse

[11] 4,165,875

[45] Aug. 28, 1979

[54] BOWLING PIN

[76] Inventor: Robert H. Dykehouse, 4578 E. 15 Mile Rd., Sterling Heights, Mich. 48077

[21] Appl. No.: 727,642

[22] Filed: Sep. 29, 1976

[51] Int. Cl.[2] ..... A63D 9/00

[52] U.S. Cl. ..... 273/82 R; 273/DIG. 12

[58] Field of Search ..... 273/72 R, 80.2, 82 R, 273/82 A, 82 B, 218, DIG. 1-12

[56] References Cited

U.S. PATENT DOCUMENTS

| | | | |
|---|---|---|---|
| 814,257 | 3/1906 | Wilson | 273/82 R |
| 1,969,378 | 8/1934 | McKenzie | 273/82 R |
| 2,395,134 | 2/1946 | McKenzie | 273/82 R |
| 2,701,719 | 2/1955 | DiPierro | 273/82 B |
| 2,950,112 | 8/1960 | Dettman | 273/82 R |
| 3,093,171 | 6/1963 | Bean et al. | 273/82 R X |
| 3,141,672 | 7/1964 | Unterbrink | 273/82 R |
| 3,159,402 | 12/1964 | Nichols | 273/82 R |
| 3,572,710 | 3/1971 | Negrini | 273/82 R |
| 3,592,717 | 7/1971 | Gaughran | 273/80.2 X |
| 3,883,145 | 5/1975 | Cox et al. | 273/218 |

FOREIGN PATENT DOCUMENTS

| | | | |
|---|---|---|---|
| 1084931 | 9/1967 | United Kingdom | 273/DIG. 12 |

*Primary Examiner*—Richard J. Apley

*Attorney, Agent, or Firm*—Basile and Weintraub

[57] ABSTRACT

A bowling pin is prepared by injection molding, a high impact polypropylene belly and, thereafter, inserting into the belly a wood laminate core. The polypropylene is utilized in the presence of a coupling agent and a blowing agent and is admixed with a filler. The products produced in accordance herewith are suitable replacements for existing wood bowling pins.

11 Claims, 5 Drawing Figures

BOWLING PIN

BACKGROUND OF THE INVENTION

1. Field of the Invention

The present invention pertains to bowling pins. More particularly, the present invention pertains to compositions and processes for manufacturing bowling pins. Even more particularly, the present invention pertains to bowling pin structures, compositions and processes therefor.

2. Prior Art

In the sport of bowling there has been developed a plurality of synthetic resinous accoutrements including bowling balls, shoes, as well as dressings for the lanes, per se. Yet, the sport has consistently employed and utilized wooden bowling pins. Although there has been proposed heretofore bowling pins formed from synthetic resins, see, inter alia, U.S. Pat. No. 3,268,636, such bowling pins have not encountered commercial utilization.

One of the major problems encountered with synthetic bowling pins as differentiated from wooden bowling pins, is strictly aesthetic. Synthetic bowling pins do not emit the same sound, upon ball impact, as do wooden pins. In essence, prior art synthetic bowling pins emit a muffled or mitted sound as compared to the resounding noise of wooden pins. This has greatly depreciated the utilization of synthetic bowling pins.

Another problem encountered with prior art synthetic bowling pins is durability. Oftentimes, the prior art synthetic pins could not reach or attain the impact strength and/or compressive strength of the hard maple used in conventional bowling pins.

The present invention, as will subsequently be detailed, provides a bowling pin formed from a synthetic resin, as well as wood, which overcomes all of the debilitating factors of the prior art and which surpasses or equals the properties of wooden pins.

SUMMARY OF THE INVENTION

In accordance with the present invention there is provided a bowling pin comprising (a) a synthetic resinous hollow outer shell and (b) a wooden laminate neck-carrying core. The core is dimensioned to be slightly larger than the interior opening or hollow of the shell or belly. The core is inserted by heating the shell to expand it and, then, inserting the core. Thereafter, the assembly is permitted to cool to room temperature. Thus, the inner core is shrink-fitted into the shell.

The outer shell or belly is formed by injection molding a high impact polypropylene in admixture with a filler and in the presence of a coupling compound and a surfactant.

The products produced in accordance herewith are comparable to and in many instances surpass conventional wooden pins.

For a more complete understanding of the present invention reference is made to the following detailed description and accompanying drawing. In the drawing, like reference characters refer to like parts throughout the several views, in which:

DETAILED DESCRIPTION OF THE PREFERRED EMBODIMENTS

Figure 1:
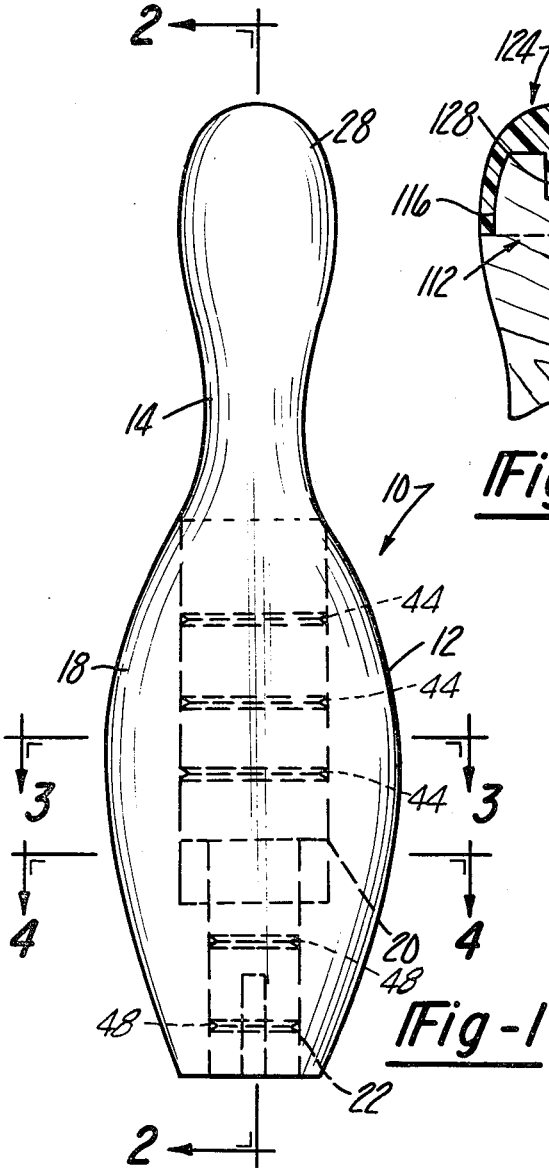
FIG. 1 is a side elevational view, partly in phantom, of a bowling pin in accordance with the present invention.

Now, and with reference to the drawing and, in particular FIGS. 1–4, there is depicted therein a bowling pin or similar structure, generally denoted at 10, in accordance with the present invention. The pin 10 hereof, generally comprises an outer shell or belly 12 and an inner core 14.

With more particularity, the belly 12 comprises a substantially flat or planar base 16 and an arcuate or curvilinear sidewall 18. The belly has an open top. The belly has a hollow interior comprising a first diameter hollow or bore 20 which extends along a substantial portion of the vertical extent of the belly. The bore 20 terminates into and communicates with a reduced diameter bore 22. The bore 22 extends upwardly from the base 16.

The belly 12 has an annular recessed groove 24 formed in the base. A nylon ring 26 is emplaced in the groove in accordance with the requirements of the American Bowling Congress.

As will subsequently be detailed, the belly 12 is formed from a synthetic resinous material.

The core 14 hereof comprises an integrally formed cap portion 28, a neck portion 30, a main body portion 32 and a shank portion 34. The core 14 comprises a wood laminate of sections 36, 38, and 40 which are laminated together by any conventional method. The laminated core has a unidirectional grain orientation which is continuous with the grain of the belly (not shown). Preferably, a scanned, maple wood laminate having the unidirectional grain is utilized as the core 14.

The cap portion 28 and the neck portion 30 of the core are disposed exteriorly of the shell or belly 12 and conform to the conventional head and neck of a bowling pin. The neck portion 30 is configured to be continuous with the upper edge 42 of the belly. In this manner no exterior discontinuities are presented.

The main body portion 32 of the core is disposed within the hollow 20 by shrink fitting, in a manner to be subsequently desired. The portion 32 has a length less than that of the hollow 20, as shown, and a diameter slightly larger than that of the hollow.

A plurality of circular grooves 44 are formed in the exterior of the main body portion 32. The grooves 44 have an adhesive emplaced therewithin for enhancing adhesion between the core and the interior of the belly. The grooves 44 are parallel and equidistantly spaced apart along the vertical extent of the main body portion.

Depending downwardly from the bottom surface of the main body portion is the shank portion 34 of the core. The shank portion 34 has a diameter slightly larger than that of the bore 22 and is emplaced therewithin by shrink fitting. The shank portion 34, which is concentric with the main body portion 32, extends from the base 16 into the interior of the belly within the hollow 20. Because the shank portion has a diameter less than that of the main body portion and has a portion thereof within the bore 20, there is, thus, defined an annular cavity 46 in the interior of the pin 10. The cavity 46 functions as a sound chamber for amplifying and reverberating the sound made upon impact with a ball. Furthermore, the cavity provides the proper balance to the pin.

Referring, again, to the drawing, the shank portion 34 has a plurality of grooves 48 circumferentially disposed therearound. The grooves 48 are formed on the exterior of the shank portion 34 which lies within the bore 22. The grooves 48 have an adhesive emplaced therewithin to promote adherence between the core and the belly in the manner heretofore described.

Figure 2:
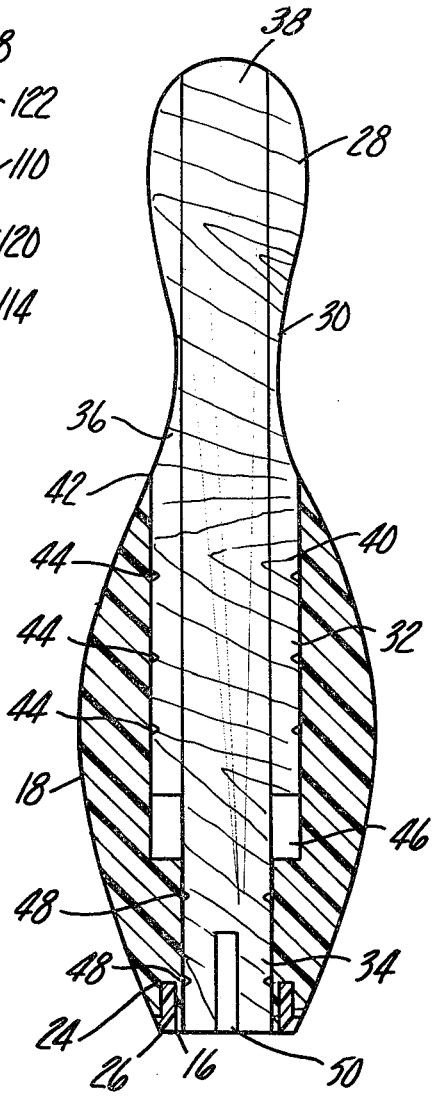
FIG. 2 is a cross-sectional view taken along the line 2—2 of FIG. 1.
Figure 3:
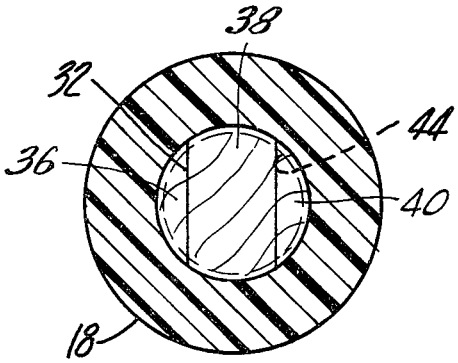
FIG. 3 is a sectional view taken along the line 3—3 of FIG. 1.
Figure 4:
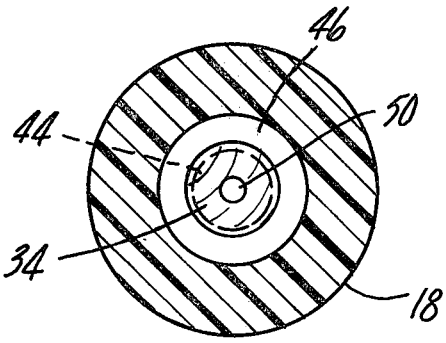
FIG. 4 is a sectional view taken along the line 4—4 of FIG. 1.

As clearly shown in FIGS. 1 and 2, the shank portion 34 has a vertical partial bore 50 formed therein. The bore 50 is formed centrally in the shank portion and extends upwardly from the base of the shank into the interior thereof. The bore 50 receives the fingers of an automatic pin setting machine (not shown).

In fabricating the pin 10 hereof the exterior is provided with an outer coating of paint or plastic to protect the belly and core and which has the conventional stripings thereon.

Figure 5:
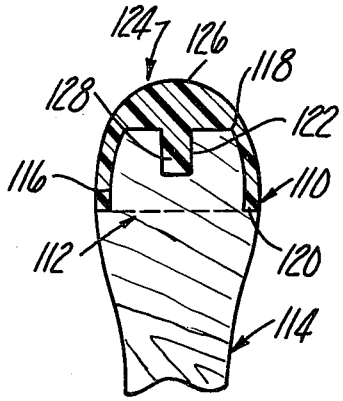
FIG. 5 is a broken, cross-sectional view of an alternate embodiment of the head of the core.

Referring, now, to FIG. 5, there is depicted therein an alternate embodiment of the present invention, generally, denoted at 110. In accordance herewith the head 112 of the core 114 includes a recessed portion 116. The recess 116 extends around the head and has an upper, substantially flat or planar surface 118. The lower terminus of the recess defines as annular seat or shoulder 120. A channel 122 is formed in the top surface 118 and depends downwardly therefrom into the interior of the head portion 112.

A cap 124 is emplaced in the recess 116 and seats on the annular shoulder 120. The cap 124 has a width equal to the width of the recess such that the exterior wall thereof in continguous with the exterior wall of the head portion 112 to avoid outer discontinuities. The top 126 of the cap has a spherical configuration to impart a bowling pin cap configuration to the assembly. The top of the cap 124 has a finger 128 which is shrink fitted into the channel 122 in the same manner as the core portions are shrink fitted into the bores of the belly.

The cap 124 is formed from the same synthetic resin as the belly to impart high impact and compressive strength to the head of the pin. As is known to the skilled artisan, it is either the head of the pin or the belly, but not the neck, which is most often subjected to impact and compression.

As hereinbefore noted, the belly and, where used, the cap, is formed from a synthetic resinous material. The material hereof consists essentially of (a) a high impact polypropylene and (b) a filler.

The propylene utilized herein is a high impact polypropylene, prepared by conventional techniques, and having a specific gravity of about 0.905. Generally, the polypropylene has an intrinsic viscosity ranging from about 2.3 to 3.7. Such polypropylenes are well known and commercially available, such as those sold by Hercules Chemicals under the codes 8623, 7523 and PC072. Optimally, a blend of such polypropylene are used herein, in any desired proportions. These polypropylenes have intrinsic viscosities within the above-defined ranges.

The polypropylene is, generally, employed in an amount ranging from about seventy-five percent to about eighty-five percent, by weight, based on the total weight of the material.

The other component in the synthetic resinous material is a filler. The filler, which must be compatible with the polypropylene and be susceptible to injection molding, generally, is employed in an amount ranging from about fifteen to about twenty-five percent, by weight, based on the total weight of the material. The filler utilized herein is selected from the group consisting of silicon dioxide, asbestos fibers and mixtures thereof. Where utilized as a mixture any desired proportions of the filler can be utilized.

The belly and/or cap is fabricated from the synthetic resinous material by the injection molding thereof. The molding of the material is, generally, carried out a temperature of from about 400° F. to about 500° F. Preferably, the temperature ranges from about 425° F. to about 475° F. In injection molding, the present material, a pressure of about eight thousand pounds per square inch (psi) is ordinarily employed.

The material is molded in the presence of a wetting agent and a blowing agent. The wetting agent and blowing agent are added separately to the material in a stepwise procedure.

Specifically, to the material is added, with agitation, the wetting agent, at room temperature and pressure. Thereafter, the blend is agitated for about five to ten minutes.

Next, the blowing agent is added to the blend, with agitation. The blowing agent is mixed into the blend for about five to ten minutes at room temperature and pressure to ensure a homogeneous mixture.

The resulting mixture is then plasticized in an extruder at the hereinbefore denoted elevated temperatures and pressures. From the extruder the mixture is then injected into a mold conforming to the desired configuration of the belly and/or cap.

The wetting agent utilized herein is, preferably, a synthetic fatty amide wax. More specifically, the wetting agent is, preferably, a fatty diamide synthetic wax. A particularly preferred type of wax is that sold by Glyco Chemicals, Inc. under the name ACRAWAX C, which is utilized as a powdered wax. ACRAWAX C has the following reported physical properties.

Melting Point—140° to 145° C.
Acid Value—8.5 max.
Gardner—1963—5 max.
Flash Point—285° C.
Specific Gravity @ 25° C.—0.95 to 0.97
Moisture Absorption—0.6% in 48 hours @ 35° C. and 100% RH
ASH Content—Less than 0.5%

As noted, this product is commercially available. Generally, the wetting agent is employed in an amount ranging from about 0.25 to 0.5 percent, by weight thereof, based on the weight of the polypropylene.

The blowing agent is utilized in an amount ranging from about one to ten percent, by weight, based on the total weight of the mixture. Preferably, the blowing agent is utilized in an amount ranging from about one to five percent, by weight, based on the total weight of the mixture.

The blowing agent, per se, comprises an admixture of azodicarbonamide, butylated hydroxy toluene and calcium silicate. The butylated hydroxy toluene functions as a coupling compound and the calcium silicate functions to promote agglomeration of the filler and polypropylene.

The azodicarbonamide is a commercially available product which, usually, is in admixture with a minor amount of finely divided colloidal or fume silica. Such products are defined in British Pat. No. 1,360,392.

The blowing agent admixture, preferably, comprises from about 89.75 to about 94.75 percent, by weight, of the azodicarbonamide; about 0.25 percent, by weight, of the butylated hydroxy toluene and from about five to ten percent, by weight, of the calcium silicate.

It should be noted with respect hereto that the blowing agent can be used in molding polypropylene, per se, and is not solely restricted to utilization herein.

In fabricating a bowling pin in accordance herewith, the belly and cap, if used, are injection molded by the procedure outlined above. Thereafter, the belly is heated to render expansible the interior thereof. Then, the main body portion and shank, having the adhesive in their grooves, are emplaced in their respective bores such that the exterior of the neck portion of the core is contiguous with the exterior of the belly and the base of the shank is coplanar with the base of the belly. Finally, the assembly is permitted to cool to room temperature whereupon the belly portion contracts, thereby, shrink fitting the core into the interior bores by virtue of the appropriate core portions having a larger diameter than their associated bores. Thereafter, the cap, if used, is fitted into the recess of the core head by the same procedure.

The bowling pin produced in accordance herewith and, as noted thereinabove, are comparable to or surpass the qualities of 100% wooden pins. To evidence this, a series of pins were prepared in accordance with the present invention. Thereafter, the pins were subjected to an American Bowling Congress type test and compared to conventional wooden bowling pins. The results of these comparisons were as follows:

| TEST | WOODEN PIN | INVENTIVE PIN |
|---|---|---|
| Durability | 5,000 bowling games, max. | 15,000 to 18,000 bowling games |
| Center of Gravity | Same for both types of pin | |
| Radius of Gyration | 13.2 to 14.8 | 14.2 |
| Scleroscope | 60 to 62 | 60 to 62 |
| Weight | 3¼ to 3½ lbs. | 3 lbs. 5 oz. |
| Scoring | 147 to 154 | 148.7 (average) |

Thus, the present pins are comparable in all physical respects to conventional wooden pins, but with much greater durability.

Having, thus, described the invention what is claimed is:

1. A bowling pin, comprising:
(a) a solid wooden core comprising a head portion, a neck portion, a main body portion and a shank portion, and
(b) a unitary, solid synthetic resinous belly comprising an arcuate sidewall, a planar bottom and an open top, the belly having a hollow interior, and wherein the main body portion and the shank portion of the core are disposed within the hollow interior, the belly extending downwardly from the neck portion of the core, the exterior of the neck portion being contiguous with the sidewall of the belly, the belly having a sufficient thickness to impart high impact and compressive strength thereto.

2. The bowling pin of claim 1 wherein:
the main body portion and the shank are provided with peripheral grooves therearound, the grooves being adapted to receive an adhesive therewithin.

3. The bowling pin of claim 1 wherein:
the hollow interior is defined by a first diameter bore extending downwardly from the open top and a second reduced diameter bore communicating with the first bore and extending downwardly therefrom to the bottom of the pin.

4. The bowling pin of claim 3 wherein:
the shank portion is disposed in the second bore and extends from the bottom of the belly into the first bore, and
the volume of the first bore around the section of the shank portion extending thereinto defines an annular cavity.

5. The bowling pin of claim 4 wherein:
(a) the main body portion of the core has a diameter slightly larger than that of the first bore, and
(b) the shank portion of the core has a diameter slightly greater than that of the second bore.

6. The bowling pin of claim 3 wherein:
the bottom of the pin has an annular recess formed therein, the recess being concentric with the second bore,
the bowling pin further comprising: a nylon ring disposed in the annular recess.

7. The bowling pin of claim 1 wherein:
(a) the belly comprises an injected molded synthetic resinous material consisting essentially of:
(1) from about seventy-five to eighty-five percent, by weight, based on the total weight of the material, of a high impact polypropylene, and
(2) from about fifteen to twenty-five percent, by weight, based on the total weight of the material, of a filler, and
(b) the core comprises a wooden laminate.

8. The bowling pin of claim 7 wherein:
the filler is selected from the group consisting of silicon dioxide, asbestos fibers and mixtures thereof.

9. The bowling pin of claim 7 which further comprises:
a cap fitted onto the head portion of the core, the cap being formed from the same material as the belly.

10. The bowling pin of claim 1 wherein:
the head portion of the core has a circumferential recess formed therearound, the head comprising a substantially flat upper surface having a downwardly directed partial bore formed centrally thereof,
the bowling pin further comprising a cap fitted onto the head portion, the cap seating in the recess of the head, the cap comprising a finger which projects into the partial bore formed in the head portion.

11. A bowling pin, comprising:
(a) a solid wooden core comprising a wooden laminate, and including a head portion, a neck portion, a main body portion and a shank portion, the head portion and neck portion defining the head and neck of the pin, respectively, and
(b) a unitary, solid belly having an arcuate side wall, a planar bottom, and an open top, the belly having a central bore extending therethrough, the belly extending downwardly from the neck of the core and being contiguous therewith, the belly being formed from an injection molded high impact polypropylene containing from about fifteen to twenty-five percent by weight of a filler selected from the group consisting of silicon dioxide, asbestos fibers and mixture thereof, the main body portion and shank portion being shrink fittedly disposed in the central bore, and wherein the belly has a sufficient thickness to impart high impact and compressive strength thereto.

* * * * *